US008744737B2

(12) United States Patent
D'Angelo

(10) Patent No.: US 8,744,737 B2
(45) Date of Patent: Jun. 3, 2014

(54) METHOD OF COLLISION PREDICTION BETWEEN AN AIR VEHICLE AND AN AIRBORNE OBJECT

(75) Inventor: Giuseppe Maria D'Angelo, Turin (IT)

(73) Assignee: Alenia Aermacchi S.p.A. (IT)

( * ) Notice: Subject to any disclaimer, the term of this patent is extended or adjusted under 35 U.S.C. 154(b) by 447 days.

(21) Appl. No.: 12/716,006

(22) Filed: Mar. 2, 2010

(65) Prior Publication Data

US 2010/0228468 A1 Sep. 9, 2010

(30) Foreign Application Priority Data

Mar. 3, 2009 (IT) ..... TO2009A0157

(51) Int. Cl.
*G08G 5/04* (2006.01)
*G08G 5/00* (2006.01)

(52) U.S. Cl.
CPC ..... *G08G 5/0008* (2013.01); *G08G 5/045* (2013.01); *G08G 5/0078* (2013.01); *G08G 5/0069* (2013.01)
USPC ..... 701/120

(58) Field of Classification Search
None
See application file for complete search history.

(56) References Cited

U.S. PATENT DOCUMENTS

| | | | | |
|---|---|---|---|---|
| 6,438,492 | B1 | 8/2002 | Le Tallec et al. | |
| 7,848,879 | B2 * | 12/2010 | Herman | 701/411 |
| 8,090,525 | B2 * | 1/2012 | Villiers | 701/120 |
| 8,103,398 | B2 * | 1/2012 | Duggan et al. | 701/24 |
| 2002/0004697 | A1 * | 1/2002 | Lai | 701/120 |
| 2002/0183900 | A1 | 12/2002 | Sainthuile | |
| 2003/0122701 | A1 * | 7/2003 | Tran | 342/29 |
| 2006/0069497 | A1 * | 3/2006 | Wilson, Jr. | 701/120 |
| 2007/0078572 | A1 | 4/2007 | Deker et al. | |
| 2009/0125221 | A1 * | 5/2009 | Estkowski et al. | 701/120 |
| 2009/0319101 | A1 | 12/2009 | Coulmeau | |

FOREIGN PATENT DOCUMENTS

| | | |
|---|---|---|
| EP | 1630766 | 1/2006 |
| FR | 2716028 | 8/1995 |
| FR | 2780701 | 1/2000 |
| FR | 2816091 | 5/2002 |
| FR | 2861871 | 11/2003 |
| FR | 2894056 | 11/2005 |
| WO | 2007/060167 | 5/2007 |
| WO | 2005/020889 | 2/2008 |

OTHER PUBLICATIONS

Derwent No. 2005-540388 dated Jan. 15, 2004 indicating Jones reference.*

(Continued)

*Primary Examiner* — John R Olszewski
*Assistant Examiner* — Jean-Paul Cass
(74) *Attorney, Agent, or Firm* — Merchant & Gould P.C.

(57) ABSTRACT

A method of predicting collisions between a mission air vehicle and an airborne object of a plurality of airborne objects present in a flight scenario of the mission air vehicle is described. The mission air vehicle and the airborne object move along corresponding routes. The method acquires data representing the state of flight and flight parameters of the plurality of airborne objects and the mission air vehicle; assigns to each of said airborne objects a mode of calculating the collision prediction; determines a subset of airborne objects to be surveilled; calculates equivalent routes for the mission air vehicle and for each airborne object of the subset; synchronizes the equivalent route of the mission air vehicle with the equivalent route of each airborne object of the subset; and calculates, for each airborne object, a collision prediction based on the synchronized routes according to an assigned calculation mode.

8 Claims, 4 Drawing Sheets

(56) References Cited

OTHER PUBLICATIONS

Derwent No. 2003-730376 dated Jan 2, 2002 indicating Johnson reference.*
IT Search Report for ITTO20090157 filed on Mar. 3, 2009 in the name of Alenia Aeronautica S.P.A.
IT Written Opinion for ITTO20090157 filed on Mar. 3, 2009 in the name of Alenia Aeronautica S.P.A.

K. Bin, Stochastic Conflict Detection for Air Traffic Control, Apr. 2000, pp. 1-91.

Prandini et al, A Probabilistic Approach to Aircraft Conflict Detection, Dec. 2000, pp. 199-220.

Zhao et al., Deterministic Resolution of Two Aircraft Conflict in Free Flight, 1997, pp. 469-478.

* cited by examiner

FIG.3
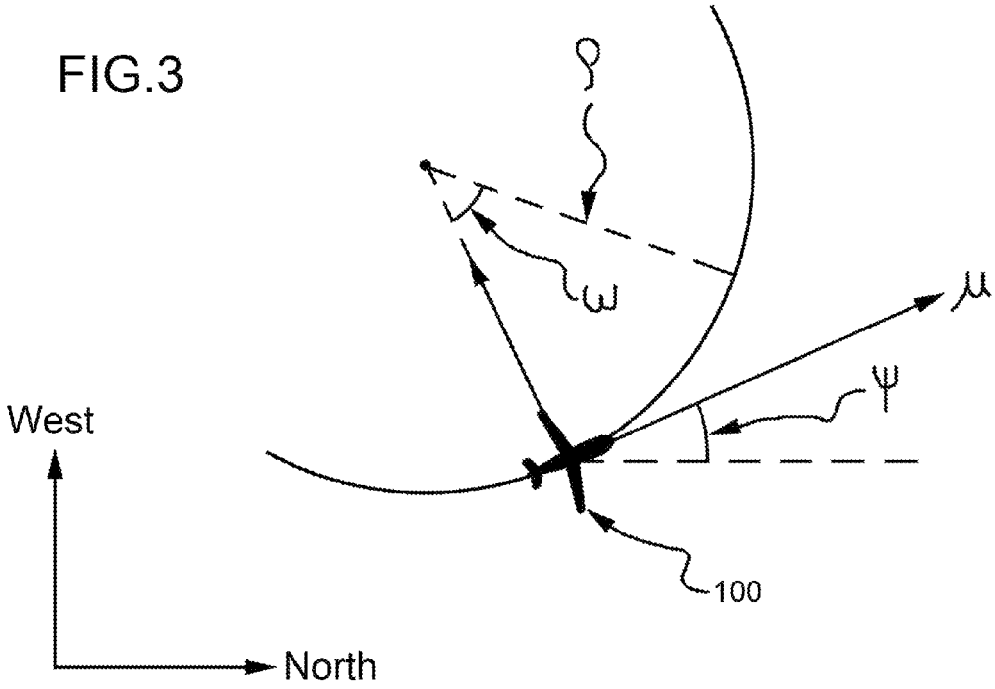
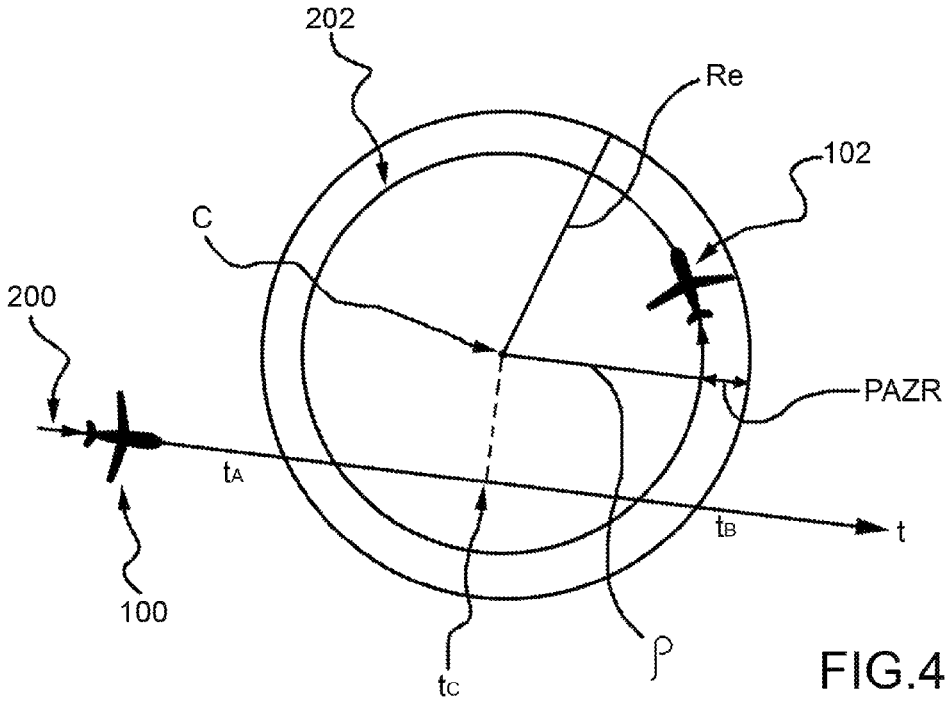
FIG.4

METHOD OF COLLISION PREDICTION BETWEEN AN AIR VEHICLE AND AN AIRBORNE OBJECT

CROSS REFERENCE TO RELATED APPLICATIONS

The present application claims priority to Italian patent application TO2009A000157 filed on Mar. 3, 2009, which is incorporated herein by reference in its entirety.

FIELD

The present disclosure relates to a method of collision prediction between an air vehicle and an airborne object, particularly between an unmanned air vehicle and an airborne object.

BACKGROUND

A necessary condition for the flight of unmanned air vehicles (UAVs) on civil flight paths is that they have an equivalent level of safety (ELOS) to that of conventional manned vehicles, in other words that they have collision avoidance systems which can reduce the risk of air-to-air collisions to an equivalent level to that which is found for manned air vehicles.

The access of unmanned air vehicles to non-segregated airspaces is dependent not only on their capacity to detect the presence of an airborne object and manoeuvre autonomously to avoid it, but also on their capacity to interpret data relating to the airspace in which they are located, as a pilot would, in other words to surveil any airborne objects present and to predict sufficiently far in advance any points of impact to be avoided.

Collision prediction systems and methods are known, for example, from EP 1 630 766 (Saab) or WO 2008020889 (Boeing). However, these systems are limited both as to the type of prediction which they can provide, since they make only a short-term prediction, and as to the operating modes which they use to make this prediction.

SUMMARY

In accordance with the present disclosure, a new method of collision prediction is provided, which can estimate in real time the risk of collision between an air vehicle and an airborne object, thus overcoming the limitations of the prior art cited above.

According to a first aspect of the present disclosure, a method of predicting collisions between a mission air vehicle and an airborne object of a plurality of airborne objects present in a flight scenario of the mission air vehicle is provided, said mission air vehicle and said airborne object moving along respective routes including fly-by or fixed radius waypoints with which corresponding turn circumferences are associated, the method comprising: acquiring data representing state of flight and flight parameters of the plurality of airborne objects; acquiring data representing state of flight and flight parameters of the mission air vehicle; assigning to each of said airborne objects a deterministic or probabilistic mode of calculating the collision prediction; determining, among said plurality of airborne objects, a subset of airborne objects to be surveilled; calculating, for the mission air vehicle and for each airborne object of said subset, equivalent routes found by replacing each of the fly-by of fixed radius waypoints with a pair of virtual waypoints which form the entry and exit points of the respective associated circumference; synchronizing the equivalent route of the mission air vehicle with the equivalent route of each airborne object of said subset, thus obtaining synchronized routes comprising an equal number of synchronized legs flown by the mission air vehicle and by the airborne object in an identical time interval, said legs linking two consecutive waypoints at which the mission air vehicle or the airborne object changes a flight parameter; and calculating, for each airborne object, a collision prediction based on said synchronized routes according to said assigned deterministic or probabilistic calculation mode.

Further aspects of the present disclosure are described in the dependent claims, the content of which is to be considered as integral and integrating part of the present description.

Briefly, the method according to the invention is based on the use of the trajectory of the unmanned air vehicle to estimate in real time the risk of collision of the air vehicle with other airborne objects (AOs) present in the scenario.

If there is a risk of collision, an alarm message is returned, comprising data on the position and probability of the impact.

In accordance with several embodiments of the present disclosure, the following are some of the applications of the described method:

- the capacity to detect long-term conflicts between 4D routes (up to 20 waypoints);
- the capacity to detect conflicts between curvilinear trajectories;
- the prediction of collisions with non-cooperative air vehicles;
- the deterministic and probabilistic collision prediction;
- the possibility of adjusting the prediction time horizon;
- the possibility of adjusting the monitoring surveillance frequency of the airborne objects according to the level of danger of the collision;
- the capacity to surveil simultaneously a plurality of colliding airborne objects, in particular up to one hundred airborne objects;
- the capacity to estimate the velocity vectors of the two air vehicles in conflict at the point of minimum separation between the air vehicles themselves;
- the possibility of dynamically diversifying and reconfiguring the alarm criteria for each airborne object.

BRIEF DESCRIPTION OF THE DRAWINGS

Further features, teachings and applications of the disclosure will be made clear by the following detailed description, provided purely by way of non-limiting example, with reference to the attached drawings, in which:

FIG. 3 is a schematic view of an air vehicle following a curvilinear route;

FIG. 4 is a diagram of the trajectories followed by an air vehicle which moves along a rectilinear trajectory and an airborne object which moves along a circular trajectory.

DETAILED DESCRIPTION

Figure 1:
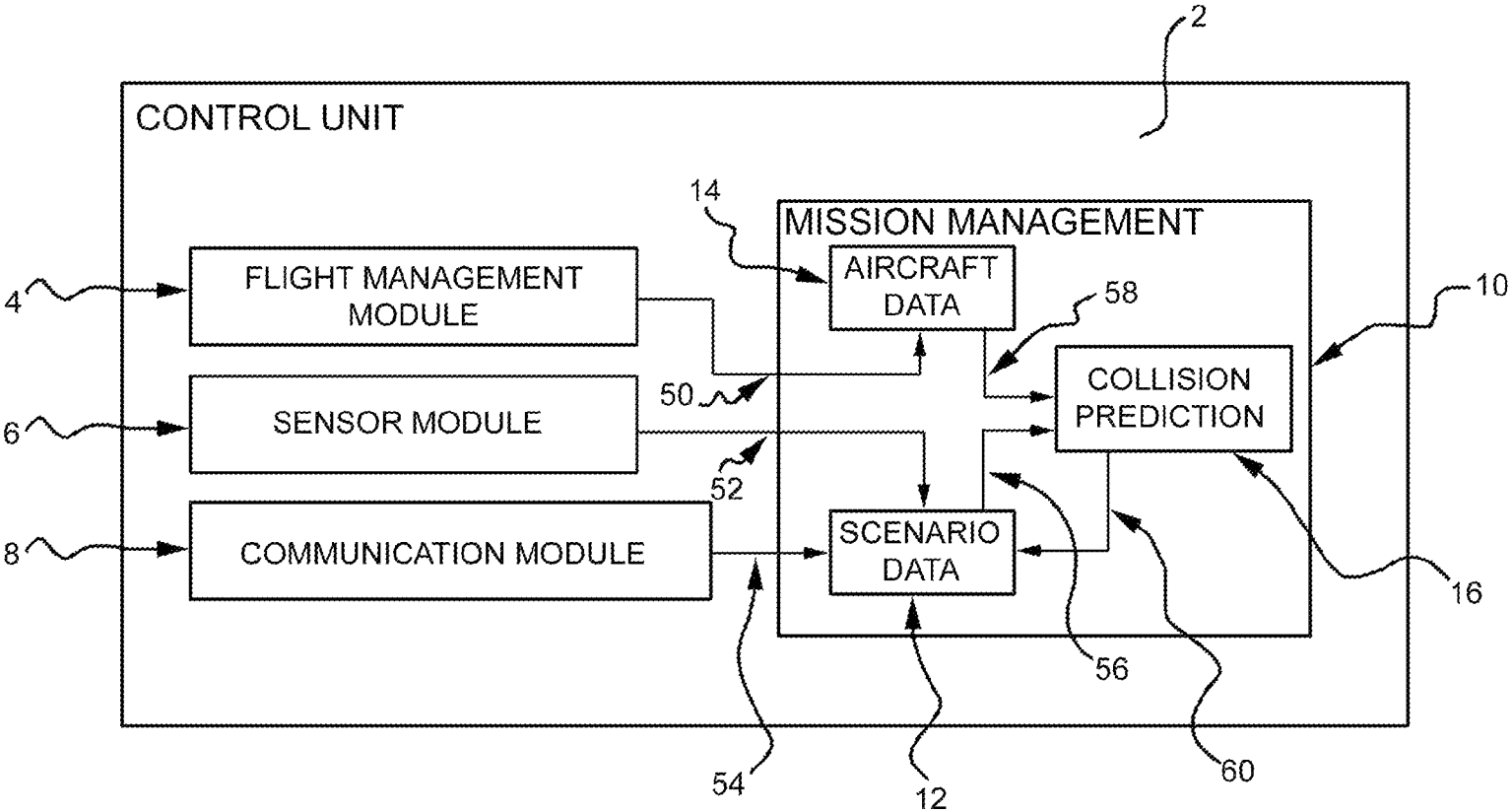
FIG. 1 is a schematic representation of an electronic control unit of an unmanned air vehicle which comprises a system arranged to perform the method according to the disclosure.

FIG. 1 shows schematically an electronic control unit 2 of an unmanned air vehicle which comprises, in a known way, a flight management module 4 for controlling and managing the flight of the unmanned air vehicle, a sensor module 6 for acquiring the data provided by the sensors associated with the air vehicle, and a communication module 8 arranged to manage the exchange of data on board the air vehicle. The flight control module 4, the sensor module 6 and the communication module 8 are arranged to communicate with a mission control module 10, which coordinates and controls the overall behaviour of the unmanned air vehicle, that is to say the flight time, the trajectory and the velocity.

The mission control module 10 comprises a scenario data management module 12, an air vehicle data management module 14, and a collision prediction module 16 arranged to perform the method according to the disclosure.

The flight management module 4 supplies data to the air vehicle data management module 14 (arrow 50), and the sensor module 6 and the communication module 8 supply data to the scenario data management control module 12 (arrows 52 and 54).

The scenario data management module 12 and the air vehicle data management module 14 supply, respectively, as shown by arrows 56 and 58, the collision prediction module 16 with data representing the scenario, in other words the airborne objects present therein, and data representing the unmanned air vehicle. These data comprise kinematic data on the airborne objects and on the unmanned air vehicle.

The data which are sent by the scenario data management module 12 to the collision prediction module 16 relate to the airborne objects whose potential risk of collision with the unmanned air vehicle and the associated danger level are to be estimated. In particular, these data include, for each airborne object:

- the 4D position (e.g. bearing, elevation, range from the unmanned air vehicle, instant of time);
- the 3D velocity (e.g. the bearing rate, the elevation rate, and the range rate);
- the route, in the sense of sequence of points of the route (waypoints), which are crossed directly (fly over waypoints) or passed on a curved path (fly-by and fixed radius waypoints);
- the danger level of the collision;
- the threshold distances, for example the radius of the minimum sphere containing the airborne object, the minimum distance from the airborne object at which the unmanned air vehicle can avoid it by an evasive manoeuvre, and the minimum safe distance which the unmanned air vehicle should maintain from the airborne object with which it is sharing the same airspace. The values of these thresholds are assigned by the mission management module 10 to each airborne object of the scenario, and are updatable in real time according to various factors such as the type of mission.

Two air vehicles are said to come into conflict when the separation between them, both vertical and horizontal, is smaller than a threshold called the "Protected Airspace Zone" (PAZ). This zone can have a cylindrical shape, in which the height of the cylinder can be expressed as a function of the radius (PAZR). This radius is the minimum safe distance which the unmanned air vehicle should maintain from the airborne object with which it is sharing the same airspace.

Two air vehicles are said to come into collision when the separation between them, both vertical and horizontal, is smaller than a threshold called the "Near Mid-Air Collision Zone" (NMAC). This zone can have a cylindrical shape, in which the height of the cylinder can be expressed as a function of the radius (NMACR). This radius is the minimum distance from the airborne object which allows the unmanned air vehicle to avoid it by an evasive manoeuvre.

As to the route of the airborne object, if this is not supplied as input datum to the collision prediction module 16, the airborne object will be considered to be non-cooperative; in this case, the airborne object's short-term route will be extrapolated from the available scenario data. About the term "cooperativeness", it is used in the following description and in the claims to indicate the propensity of the airborne object to supply its route to the unmanned air vehicle.

The 4D position and the 3D velocity constitute the kinematic data of the airborne object.

The data which are sent by the air vehicle data management module 14 to the collision prediction module 16 can be grouped into three types, namely:

flight data (kinematic);
mission data; and
configuration data.

Flight Data

These are data representative of all the information concerning the state of the flight of the unmanned air vehicle, and are required for the prediction of a possible collision with airborne objects. In particular, these data should include at least the following information:

- the attitude angles;
- the angular velocity (w);
- the 4D position (e.g. latitude, longitude, altitude, instant of time);
- the 3D translational velocity (e.g. north, east, down).

Mission Data

These are data representative of all the information relating to the currently active mission of the air vehicle, namely:

- the sequence of waypoints which form the active route;
- the characteristics of each waypoint (e.g. 4D position, type of passage through the waypoint, turn radius, etc.);
- the next waypoint on the route to be reached.

Alternatively, the air vehicle does not move along a route identified in advance, but is in a state of unplanned flight. In this case, only the instantaneous direction of the air vehicle is known, and the method according to the disclosure is applied simply by assigning a brief time interval, for example less than 10 s, to the time horizon, on the assumption that the air vehicle moves, in this time interval, along the trajectory extrapolated by the available flight data. The method is then repeated with the resulting data updated.

Configuration Data

These are data representative of the configuration parameters of the prediction module 16, in particular:

- the index of the surveillance tables: this tells the prediction module 16 which of a plurality of internally available "surveillance tables" (described below) it should use to generate the frequency of surveillance of the airborne objects of the scenario. Each of these tables couples a plurality of surveillance frequencies in a different way to the maximum number of airborne objects which can be monitored at this frequency;
- the time horizon: this is the time interval up to which the prediction module 16 searches for possible conflicts and/or collisions with airborne objects of the scenario. If the air vehicle is in a state of unplanned flight, the time horizon is, for example, fixed at 10 s;
- the critical time: the time within which the prediction module 16 is required to generate a critical alarm message, for example a message indicating that the unmanned air vehicle is approaching the conflict or collision region;
- the lethal time: the time within which the prediction module 16 is required to generate a lethal alarm message, for example, representative of the fact that the unmanned air vehicle has entered the conflict or collision region;

the prediction mode: a data element representative of the type of prediction (deterministic or probabilistic) which is to be used. Alternatively, this data element tells the collision prediction module 16 to calculate the type of prediction to be used, as described below.

The collision prediction module 16 supplies the scenario data management module 12 (arrow 60) with data comprising, for each airborne object for which the collision prediction module 16 has predicted a collision, the danger level of the collision and all the information relating to the instant, the place and the probability of the impact.

In particular, the collision prediction module 16 supplies the following information:

the prediction mode (probabilistic, deterministic);

the probability of occurrence of the conflict and/or collision;

the time interval which will elapse before the minimum separation distance between the unmanned air vehicle and the airborne object is reached;

the spatial distance to be covered before the minimum separation distance between the unmanned air vehicle and the airborne object is reached;

the minimum separation distance between the unmanned air vehicle and the airborne object;

the danger level of the collision;

the 3D position (i.e. latitude, longitude and altitude) of the unmanned air vehicle in the time which will elapse before the minimum separation between the unmanned air vehicle and the airborne object is reached;

the 3D position (i.e. latitude, longitude and altitude) of the colliding airborne object in the time which will elapse before the minimum separation between the unmanned air vehicle and the airborne object is reached;

the velocity of the unmanned air vehicle at the point of minimum separation;

the velocity of the airborne object at the point of minimum separation.

Figure 2:
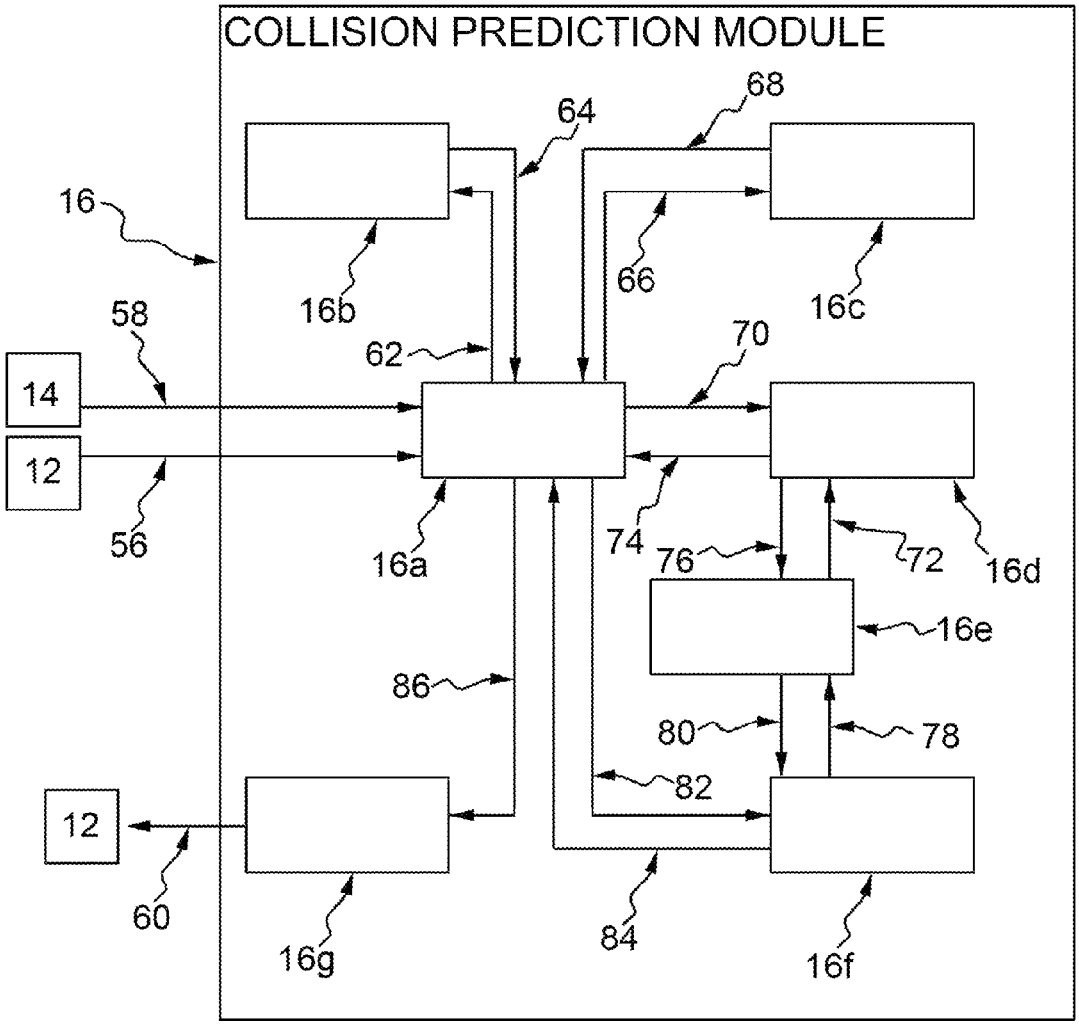
FIG. 2 is a schematic representation of the system arranged to perform the method according to the disclosure.

FIG. 2 is a schematic illustration of the functional architecture of the collision prediction module 16. Said collision prediction module 16 comprises a plurality of sub-modules, more particularly seven sub-modules 16*a*-16*g*, each sub-module 16*a*-16*g* being arranged to perform a specific function as described below.

The first sub-module 16*a* receives (arrows 56 and 58) the data from the scenario data management module 12 and the air vehicle data management module 14, and manages the internal data exchange between the sub-modules 16*a*-16*g*. In particular, it transmits (arrow 62) the data on the airborne objects to the second sub-module 16*b*, and acquires from said second sub-module 16*b* (arrow 64) the marking data for each airborne object, which serve to identify which of the airborne objects are to be monitored, as described below.

The first sub-module 16*a* also converts the flight data of the unmanned air vehicle (typically expressed in the BER polar system) to kinematic data referred to a predetermined Cartesian reference system (such as the North, West, Up (NWU) system) associated with the air vehicle.

The second sub-module 16*b* uses the data of the airborne objects obtained (arrow 62) from the first sub-module 16*a*, and assigns the marking data to the airborne objects according to their danger level. Said marking data can comprise data representing the fact that a given airborne object has to be monitored and data representing the type of algorithm (deterministic or probabilistic) which is to be used, as explained below.

In particular, a temporal distance from the unmanned air vehicle $t_D$ is determined for each airborne object, using the following equation:

$$t_D = -\frac{R}{RR} \tag{1}$$

where R is the range and RR is the range rate of the airborne object. A high constant value can be assigned to the temporal distance $t_D$ if the airborne object is moving away ($RR \geq 0$).

A score is then assigned to the airborne object, depending on the temporal distance $t_D$, the danger level of the collision, the range and the cooperativeness.

At this point, if a prediction mode has not yet been selected, a threshold value is selected, and if the temporal distance $t_D$ is below this threshold value the deterministic algorithm is assigned to the airborne object; otherwise, the probabilistic algorithm is assigned.

The various airborne objects are then ranked in decreasing order of scores, and finally the total number of airborne objects to be monitored in each cycle is extracted from a predetermined surveillance table, together with an indication of which specific airborne objects are to be monitored in a given cycle. The selected surveillance table is the one associated with the index of the surveillance tables which the air vehicle data management module 14 has sent to the first sub-module 16*a*.

Thus, only certain airborne objects out of all those present in the scenario are selected and monitored in each cycle.

The procedure described above is repeated at successive time intervals; thus all the airborne objects present in the scenario are monitored periodically, but the surveillance frequency differs for each airborne object and is a function of the assigned score. Additionally, the surveillance frequency for each airborne object can vary from one cycle to another.

The third sub-module 16*c* acquires from the first sub-module (arrow 66) the kinematic data on the unmanned air vehicle referred to the Cartesian reference system and the kinematic data on the airborne objects selected by the second sub-module 16*b* , converts the kinematic data on the airborne objects and refers them to the Cartesian reference system, extrapolates the angular velocity of each airborne object in a known way, and sends all the resulting data (arrow 68) to the first sub-module 16*a*.

The fourth sub-module 16*d* predicts any conflict between the unmanned air vehicle and one airborne object out of those selected previously, to which the deterministic algorithm has been assigned.

For this purpose, it acquires the following data (arrow 70) from the first sub-module 16*a:* kinematic data relating to the unmanned air vehicle and to the airborne object, referred to the Cartesian reference system;

the time horizon and the active route of the unmanned air vehicle;

the minimum safe distance which the air vehicle should maintain from an airborne object with which it shares the same airspace; and the route of the airborne object.

The fourth sub-module 16*d* then calculates, for both the unmanned air vehicle and the airborne object, equivalent routes found by replacing each of the fly-by/fixed radius waypoints of the route with two virtual waypoints which form the entry and exit points of a turning circumference associated with each fly-by/fixed radius waypoint. Said equivalent routes are sent to the fifth sub-module 16*e* which uses them to carry out the synchronization described below.

The fourth sub-module 16*d* then acquires from the fifth sub-module 16*e* (arrow 72) the routes synchronized between the air vehicle and the airborne object respectively, and calculates data representative of a deterministic collision prediction, which are returned (arrow 74) to said first sub-module 16*a*.

The operation of calculating data representing a deterministic collision prediction comprises the steps of:

- dividing the synchronized routes of the air vehicle and airborne object into a plurality of legs, each leg linking two consecutive waypoints;
- coupling each leg of the route of the air vehicle with the corresponding synchronized leg of the route of the airborne object, thus obtaining a pair of legs;
- determining which class each pair of legs belongs to, said class being, for example, a segment-segment, segment-arc or arc-arc class;
- determining, for each pair, the instant and distance of minimum separation between the air vehicle and the airborne object, as described below;
- verifying the existence of a conflict and/or collision as a function of the minimum separation distance and the minimum safe distance which the unmanned air vehicle has to maintain from the airborne object with which it shares the same airspace;
- if a conflict and/or collision exists, calculating the time interval and the spatial distance to be flown before the minimum separation between the unmanned air vehicle and the airborne object is reached. The last-mentioned data are those which represent the deterministic collision prediction.

To determine the instant and distance of minimum separation between the air vehicle and the airborne object, the known Zhao algorithm is used, this algorithm being modified in such a way that it is also possible to predict conflicts and/or collisions in the case of legs of the segment-arc or arc-arc type. This is because the Zhao algorithm can determine conflicts and/or collisions between air vehicles which move solely in a straight line (segment-segment pairs).

FIG. 3 shows a schematic view of an unmanned air vehicle 100 which is following a curvilinear route in the horizontal plane identified by the North and West axes (the x and y axes) of the Cartesian reference system.

The air vehicle 100 is turning along an arc of circumference with a radius ρ.

When the angular velocity ω is zero, the position x of the air vehicle 100 is given by:

$$x(t)=x(0)+ut \tag{2}$$

where u is the velocity vector (assumed to be constant) in the Cartesian reference system and x(0) is the position at the initial instant.

When the angular velocity ω is different from zero, the position is given by:

$$x(t) = x(0) + L(\psi)\begin{bmatrix} \rho\sin(|\omega|t) \\ \rho(1-\cos(|\omega|t)) \\ u_z t \end{bmatrix} \tag{3}$$

where $$L(\psi) = \begin{bmatrix} \cos\psi & -\sin\psi & 0 \\ \sin\psi & \cos\psi & 0 \\ 0 & 0 & 1 \end{bmatrix}$$

is the transformation matrix from the Body Axes Reference system to the Cartesian system, ρ=|u |/ |ω| is the radius of the circular trajectory, and Ψis the angle formed between the velocity vector u and an axis parallel to the North axis of the Cartesian system.

The distance between an airborne object and the air vehicle 100 varies as a function of the types of trajectory or route followed. In particular, if the air vehicle 100 and the airborne object are both following a rectilinear trajectory, we find:

$$d(t)=[x_{AO}(0)+u_{AO}t]-[x_{UAV}(0)+u_{UAV}t] \tag{4}$$

where d(t) is the distance as a function of time, the subscript AO refers to the airborne object, and the subscript UAV refers to the air vehicle 100.

If the air vehicle 100 has a rectilinear trajectory and the airborne object has a circular trajectory, we find:

$$d(t) = x_{AO}(0) + L(\psi_{AO})\begin{bmatrix} \rho_{AO}\sin(|\omega_{AO}|t) \\ \rho_{AO}(1-\cos(|\omega_{AO}|t)) \\ u_{z,AO}t \end{bmatrix} - [x_{UAV}(0) + u_{UAV}t] \tag{5}$$

If the air vehicle 100 has a circular trajectory and the airborne object has a rectilinear trajectory, we find:

$$d(t) = x_{AO}(0) + u_{AO}t - \left\{x_{UAV}(0) + L(\psi_{UAV})\begin{bmatrix} \rho_{UAV}\sin(|\omega_{UAV}|t) \\ \rho_{UAV}(1-\cos(|\omega_{UAV}|t)) \\ u_{z,UAV}t \end{bmatrix}\right\} \tag{6}$$

If the air vehicle 100 and the airborne object both have a curvilinear trajectory, we find:

$$d(t) = x_{AO}(0) + L(\psi_{AO})[\rho_{AO}\sin(|\omega_{AO}|t)\rho_{AO}(1-\cos(|\omega_{AO}|t))u_{z,AO}t] - \{x_{UAV}(0) + L(\psi_{UAV})[\rho_{UAV}\sin(|\omega_{UAV}|t)\rho_{UAV}(1-\cos(|\omega_{UAV}|t))u_{z,UAV}t]\}$$

The calculation of the minimum separation distance between the air vehicle 100 and the airborne object, and the calculation of the time interval which will elapse before this distance is reached, are carried out using an iterative local minimum search process, applied to the appropriate equation of the distance between the airborne object and the air vehicle 100. The iterative calculation is carried out for the whole duration of the time horizon.

The algorithm detects a conflict when, at the minimum separation distance, the air vehicle is in the PAZ; the algorithm detects a collision when the air vehicle is in the NMAC zone.

The iterative local minimum search can be executed by applying the known Brent method which is modified in order to determine the first minimum separation distance having a value less than or equal to PAZR. This is because the distance equation can have more than one local minimum when the unmanned air vehicle or airborne object follows a circular trajectory. The known Brent method would output a single minimum selected in a random way from said plurality of minima. To avoid this, the procedure described below is followed, with two cases distinguished:

a) the air vehicle follows a rectilinear trajectory and the airborne object follows a circular one, or vice versa;
b) both the air vehicle and the airborne object follow a circular trajectory.

FIG. 4 is a diagram of the trajectories followed by an air vehicle 100 which moves along a rectilinear trajectory 200 and an airborne object 102 which moves along a circular trajectory 202 with a centre C. Alternatively, the air vehicle 100 moves along a circular trajectory and the airborne object 102 moves along a rectilinear trajectory. An initial instant of time $t_0$ is associated with the initial position of the air vehicle 100.

In order to use the Brent method, it is first necessary to determine an intermediate time interval $t_W$, as described below.

An equivalent radius $R_e$ (see FIG. 4) is calculated as the sum of the radius ρ of the circular trajectory 202 and the radius PAZR of the PAZ.

A central instant of time $t_c$ is calculated, this being the instant of time at which the air vehicle 100 passes through the projection of the centre C on the trajectory of the air vehicle 100.

The time interval required for the air vehicle 100 to travel a distance equal to the equivalent radius $R_e$ is then subtracted from $t_c$, resulting in a first time $t_A$ along the spatial-temporal axis of the air vehicle 100.

Similarly, the time interval required for the air vehicle 100 to travel a distance equal to the equivalent radius $R_e$ is added to $t_c$ to give a second time $t_B$ along the spatial-temporal axis of the air vehicle 100.

Finally, the intermediate time interval $t_W$ is calculated as the difference between $t_B$ and $t_A$.

At this point the intermediate time interval $t_W$ has to be divided into a plurality of sub-intervals in such a way that there is only one local minimum in each sub-interval.

The duration of these sub-intervals is equal to the shortest time interval between the difference between $t_C$ and $t_A$ (or the difference between $t_C$ and $t_0$, if $t_0$ is greater than $t_A$, or the difference between $t_B$ and $t_0$, if $t_0$ is greater than $t_C$) and the period $T=2\pi/|\omega|$ of the circular trajectory.

The known Brent method is applied to each of these sub-intervals until the first local minimum in terms of violation of the minimum separation distance is found.

Figure 5:
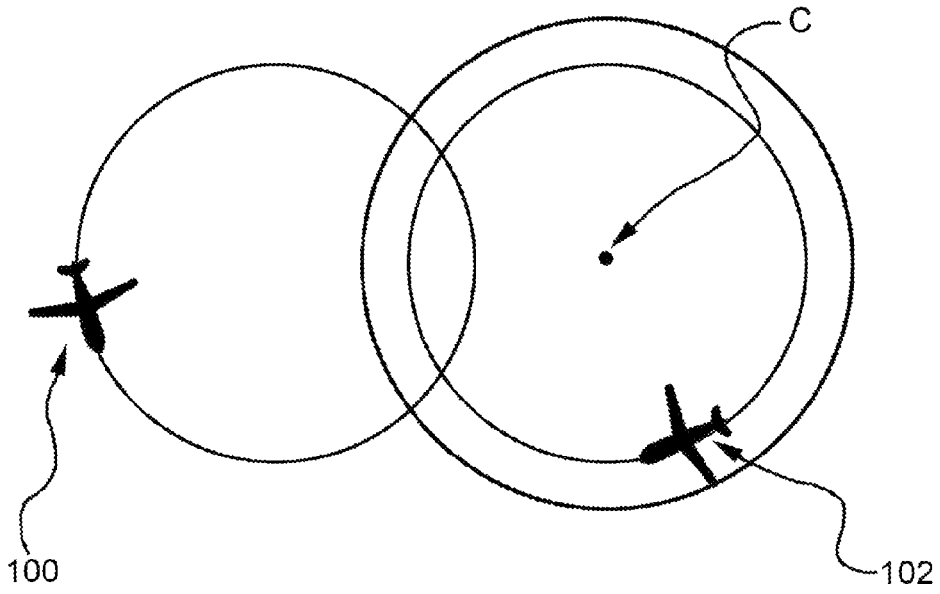
FIG. 5 is a diagram of the trajectories followed by an air vehicle and an airborne object which both move along a circular trajectory.

The procedure described above is also applicable in cases in which both the air vehicle 100 and the airborne object 102 follow circular trajectories, as shown in FIG. 5. In this case, the instants $t_A$ and $t_B$ represent the instants in which the air vehicle 100 intersects the circular trajectory of equivalent radius $R_e$ associated with the airborne object 102.

Returning to FIG. 2, the fifth sub-module **16*e*** synchronizes the route of the unmanned air vehicle with that of each airborne object, by inserting virtual waypoints into both routes to identify all, and only, the points at which the airborne object or the unmanned air vehicle changes one of its flight parameters.

For this purpose, said fifth sub-module **16*e* acquires the equivalent routes from the fourth sub-module 16*d* (arrow 76) and from the sixth sub-module 16*f* which is described below (arrow 78), synchronizes the equivalent routes and supplies them, respectively, to the fourth sub-module 16*d* (arrow 72) and to the sixth sub-module 16*f* (arrow 80**), which use them to execute the deterministic and the probabilistic algorithms respectively.

For the synchronization, the known Blin method is used, with modifications made to it in order to extend its applicability to pairs of legs of the segment-arc and arc-arc type.

The Blin method represents the trajectory of an air vehicle by means of trajectory change points (TCP) which are points on a route at which an air vehicle changes one of its flight parameters; the time and velocity at which these points will be reached are also estimated.

In particular, the instants at which the air vehicle or airborne object changes its velocity or angular velocity are determined, and synchronized routes are calculated, comprising synchronized legs which are functions of the position of the air vehicle at the instant preceding the instant of change of velocity, the time taken to fly the legs, and the velocities (linear and angular) of the air vehicle through the leg.

By contrast with the standard Blin method, therefore, the trajectory change points are not treated simply as instantaneous turning waypoints, but are also treated as fly-by/fixed radius waypoints.

For each airborne object, these synchronized routes, in other words routes composed of the same number of synchronized legs flown by the unmanned air vehicle and by the airborne object in the same time interval, are transmitted to the fourth sub-module **16*d* and to the sixth sub-module 16*f***.

The sixth sub-module **16*f*** predicts a possible conflict between the unmanned air vehicle and an airborne object from the group selected previously, to which a data element has been assigned to indicate that a probabilistic algorithm is to be used.

For this purpose, said sixth sub-module **16*f* acquires the synchronized routes of the unmanned air vehicle and the airborne object from the fifth sub-module 16*e* (arrow 80), and acquires the following data from the first sub-module 16*a* (arrow 82**):

- kinematic data relating to the unmanned air vehicle and to the airborne object, referred to the aforesaid reference system;
- the time horizon and the route of the unmanned air vehicle;
- the minimum safe distance which the air vehicle should maintain from an airborne object with which it shares the same airspace and the route of the airborne object.

The sixth sub-module **16*f* then calculates, for both the unmanned air vehicle and the airborne object, equivalent routes found by replacing each of the fly-by/fixed radius waypoints of the route with two virtual waypoints which form the entry and exit points of the turning circumference associated with each fly-by/fixed radius waypoint. These equivalent routes are sent to the fifth sub-module 16*e*** which uses them to carry out the synchronization described above.

The sixth sub-module **16*f* processes the aforesaid data which have been acquired, obtaining data representing a probabilistic collision prediction, which are returned (arrow 84) to said first sub-module 16*a***.

Said processing comprises the following steps:

- dividing the synchronized routes of the unmanned air vehicle and the airborne object into a plurality of legs, each leg linking two consecutive waypoints;
- coupling each leg of the route of the unmanned air vehicle to the corresponding synchronized leg of the route of the airborne object, thus obtaining a pair of legs;
- determining which class each pair of legs belongs to, said class being, for example, a segment-segment, segment-arc or arc-arc class;
- determining the probability of conflict and/or collision for each pair, by applying, for example, the Prandini method to which modifications are made in order to extend its applicability to pairs of legs of the segment-arc and arc-arc type, as described below;
- if a conflict and/or collision exists, calculating the mean values of the time interval and the spatial distance to be flown before the minimum separation between the unmanned air vehicle and the airborne object is reached. The last-mentioned data are those which represent the probabilistic collision prediction.

To apply the Prandini method, an air vehicle turning for a time T is considered to be an air vehicle which is stationary for a time T, positioned at the centre of curvature of the turn and having a radial extension R', where R' is the radius of curvature. Thus a segment-arc pair is treated as a segment-segment pair in which one of the two segments is a point, in other words the centre of curvature of the turn.

At this point, the first sub-module 16*a* processes said data representing a deterministic and probabilistic collision prediction, and produces final collision data which indicate those airborne objects for which a probability of collision has been detected. Said final collision data are supplied (arrow 86) to the seventh sub-module 16*g*, which generates (arrow 60) an alarm message comprising a danger level of each airborne object and the modality with which the possible collision will occur.

The type of alarm message can vary according to the time which will elapse before minimum separation is reached (which is compared with the time horizon, the critical time and the lethal time), the spatial distance to be covered before minimum separation is reached, and the minimum separation distance between the unmanned air vehicle and the airborne object, which are compared with the radius of the sphere containing the airborne object, the PAZR and the NMACR.

Although the method according to the disclosure has been described with reference to an unmanned air vehicle, it can also be applied to a manned air vehicle.

Naturally, the principle of the disclosure remaining the same, the embodiments and details of construction may be varied widely with respect to those described and illustrated, which have been given purely by way of non-limiting example, without thereby departing from the scope of protection of the present invention as defined by the attached claims.

In particular, although only the collision condition has been mentioned in the claims, a conflict prediction method is also to be considered as falling within the scope of protection of the patent.

The invention claimed is:

1. A control system for a mission air vehicle, comprising:

a scenario management module providing data representing a plurality of airborne objects including, for each of the plurality of airborne objects, a danger level of a conflict predicted in a previous cycle;

an air vehicle data management module outputting data representing the mission air vehicle;

a collision prediction module periodically acquiring the outputs of the scenario management module and the air vehicle data management module, the collision prediction module configured to periodically calculate collision prediction data and feedback the calculated collision prediction data to the scenario management module;

the collision prediction module having a plurality of sub-modules, including:

a first sub-module receiving the outputs of the scenario management module and the air vehicle data management module, and configured to manage the data exchange among the plurality of sub-modules, select a subset of the plurality of airborne objects to be monitored in a given cycle, and output conflict data;

a second sub-module receiving the data representing the plurality of airborne objects from the first sub-module, the second sub-module configured to assign to each of the airborne objects a score based at least in part on the danger level of a conflict predicted in a previous cycle, and assign one of a deterministic mode of calculating a collision prediction and a probabilistic mode of calculating a collision prediction, the second sub-module outputting the assigned scores and assigned mode of collision prediction, wherein the first sub-module selects the subset of the plurality of airborne objects based on a predetermined surveillance table and the scores assigned to the airborne objects by the second sub-module;

a third sub-module acquiring kinematic data output by the first sub-module for each of the airborne objects of the subset, and configured to extrapolate angular velocity data for each of the airborne objects of the subset and output the angular velocity data to the first sub-module;

a fourth sub-module acquiring from the first sub-module a route of the unmanned vehicle and the routes of the airborne objects of the subset selected by the first sub-module and to which the second sub-module assigned the deterministic mode of calculating the collision prediction, the fourth sub-module configured to calculate equivalent routes for the mission vehicle and each of the selected airborne objects, and execute the deterministic mode of calculating a collision prediction for each of the airborne objects assigned the deterministic mode of calculating the collision prediction, the fourth sub-module outputting data representative of the deterministic collision prediction to the first sub-module such that the conflict data output by the first sub-module is based on the conflict prediction data output by the fourth sub-module;

a fifth sub-module receiving the equivalent routes from the fourth sub-module, and configured to synchronize the equivalent routes by inserting virtual waypoints into the equivalent routes to identify points at which the airborne object and the unmanned air vehicle change a flight parameter and by modeling two consecutive waypoints with continuous-time functions that are also functions of the linear velocity and angular velocity, the fifth sub-module outputting the synchronized routes to the fourth sub-module for executing the deterministic mode of calculating a collision prediction;

a sixth sub-module acquiring from the first sub-module the route of the unmanned vehicle and the routes of the airborne objects of the subset selected by the first sub-module and to which the second sub-module assigned the probabilistic mode of calculating the collision prediction, the sixth sub-module configured to calculate equivalent routes for the mission vehicle and each of the selected airborne objects, and execute the probabilistic mode of calculating a collision prediction for each of the airborne objects assigned the probabilistic mode of calculating the collision prediction, the sixth sub-module outputting data representative of the probabilistic collision prediction to the first sub-module such that the conflict data output by the first sub-module is based on the conflict prediction data output by the sixth sub-module;

the fifth sub-module receiving the equivalent routes from the sixth sub-module, and configured to synchronize the equivalent routes by inserting virtual waypoints into the equivalent routes to identify points at which the airborne object and the unmanned air vehicle change a flight parameter and by modeling two consecutive waypoints with continuous-time functions that are also functions of the linear velocity and angular velocity, the fifth sub-module outputting the synchronized routes to the sixth sub-module for executing the probabilistic mode of calculating a collision prediction;

a seventh sub-module receiving from the first sub-module the conflict data of the airborne objects for which a probability of conflict has been detected, and configured to generate for each of the conflicting airborne objects a danger level and an alarm message including the danger level and a modality with which the possible conflict will occur, the seventh sub-module sending the alarm message to the scenario management module; and wherein the scenario management module feeds back the danger level of a conflict to the collision prediction module.

2. The control system according to claim 1, wherein the fourth and sixth sub-modules outputting the data representative of the deterministic and probabilistic conflict predictions, respectively, are configured for:

coupling each leg of a synchronized route of the mission air vehicle to a corresponding leg of the synchronized route of the airborne object, thus obtaining pairs of legs;

classifying each pair of legs in terms of segment-segment, segment-arc, arc-arc;

applying to each pair of legs an algorithm that is customized to an identified class; and determining, when a collision is predicted, kinematic features of the collision.

3. The control system according to claim 2, wherein the fourth sub-module outputting the data representative of the deterministic conflict prediction is further configured to execute an iterative local minimum search procedure when the prediction is applied to a pair of legs including an arc, the local minimum representing a minimum separation distance from the airborne object.

4. The control system according to claim 2, wherein the sixth sub-module outputting the data representative of the probabilistic conflict prediction is further configured for modeling a turning aircraft as a cylindrical risky region to be avoided when the prediction is applied to a pair of legs including an arc, the cylindrical risky region being used to compute a probabilistic feature of the collision.

5. The control system according to claim 1, wherein the predetermined surveillance table specifies surveillance frequencies to be used for surveilling the plurality of airborne objects and a maximum number of the airborne objects that, for each frequency, can be surveilled at that frequency.

6. The control system according to claim 1, wherein the score assigned to each airborne object is computed as a function of a temporal and a radial distance from the mission air vehicle, a danger level of a possible collision between the mission air vehicle and the airborne object, and a cooperativeness of the airborne object.

7. The control system according to claim 1, wherein the danger level of the conflict is customized to the airborne object and is computed as function of:

a minimum separation distance compared with threshold distances of the airborne object;

a time remaining before achieving the minimum separation distance, compared with a time horizon and other time thresholds; and a spatial distance to be covered before achieving the minimum separation distance.

8. The control system according to claim 1, wherein the alarm message identifies the airborne object involved in the conflict, specifies whether the mode of calculating the collision prediction is deterministic or probabilistic, provides kinematic features of the conflict and comprises:

a probability of occurrence of the conflict or collision;

a minimum separation distance between the air vehicle and the airborne object, a spatial distance to be covered before reaching the minimum separation distance, and a danger level of the conflict.

* * * * *